US007008144B2

(12) United States Patent
McGinn

(10) Patent No.: US 7,008,144 B2
(45) Date of Patent: Mar. 7, 2006

(54) SEDIMENT CONTROL

(76) Inventor: John H. McGinn, 59 Maple Dr., Sacramento, CA (US) 95823

( * ) Notice: Subject to any disclaimer, the term of this patent is extended or adjusted under 35 U.S.C. 154(b) by 0 days.

(21) Appl. No.: 10/843,010

(22) Filed: May 11, 2004

(65) Prior Publication Data

US 2005/0135883 A1 Jun. 23, 2005

Related U.S. Application Data

(63) Continuation-in-part of application No. 10/742,076, filed on Dec. 19, 2003, now Pat. No. 6,848,866.

(51) Int. Cl.

| | |
|---|---|
| ***E02B 3/00*** | (2006.01) |
| ***E02D 17/20*** | (2006.01) |
| ***B32B 19/00*** | (2006.01) |
| ***D04H 5/00*** | (2006.01) |

(52) U.S. Cl. ..... 405/302.6; 405/15; 405/19; 405/32; 405/302.7; 210/170; 210/747; 442/327; 428/357

(58) Field of Classification Search ..... 405/15, 405/16, 19, 32, 302.4, 302.6, 302.7; 210/170, 210/747; 442/361, 366, 367, 327; 428/357, 428/372

See application file for complete search history.

(56) References Cited

U.S. PATENT DOCUMENTS

| | | | | |
|---|---|---|---|---|
| 3,112,262 A * | 11/1963 | Parkinson | 210/130 |
| 3,455,112 A | 7/1969 | Twele | 405/19 |
| 4,854,773 A | 8/1989 | Nicoll | 405/15 |
| 5,108,224 A | 4/1992 | Cabaniss et al. | 405/52 |
| 5,257,878 A | 11/1993 | Peterson | 405/15 |
| 5,338,131 A | 8/1994 | Bestmann | 405/24 |
| 5,575,584 A | 11/1996 | Alsop | 405/24 |
| 5,632,888 A * | 5/1997 | Chinn et al. | 210/163 |
| 5,733,825 A * | 3/1998 | Martin et al. | 428/372 |
| 5,954,451 A * | 9/1999 | Presby | 405/49 |
| 6,277,473 B1 | 8/2001 | McGinn | 428/188 |
| 6,332,737 B1 | 12/2001 | Mattson | 405/63 |
| 6,422,787 B1 | 7/2002 | Mikell | 405/15 |
| 6,497,532 B1 | 12/2002 | McGinn | 405/27 |
| 6,547,493 B1 | 4/2003 | Spangler et al. | 405/302.6 |
| 6,551,505 B1 * | 4/2003 | Chinn et al. | 210/164 |
| 6,641,335 B1 | 11/2003 | Allard | 405/302.6 |
| 6,733,209 B1 * | 5/2004 | Allard | 405/302.6 |
| 6,811,708 B1 * | 11/2004 | Shaw et al. | 210/747 |
| 6,848,866 B1 * | 2/2005 | McGinn | 405/302.6 |
| 2003/0143026 A1 * | 7/2003 | Santha | 405/15 |

FOREIGN PATENT DOCUMENTS

| | | |
|---|---|---|
| GB | 2171131 | * 8/1986 |

* cited by examiner

*Primary Examiner*—Jong-Suk (James) Lee
(74) *Attorney, Agent, or Firm*—T.H.P. Richardson

(57) ABSTRACT

A sediment control roll includes a threshold member having large apertures therethrough, a hollow sediment collection chamber, and an outflow filter having small apertures therethrough. The sediment control roll can be used to collect sediment in runoff from a construction site, or to reduce removal of sediment from an existing land mass. The sediment control roll can for example be made by rolling up extruded polymeric netting with filter cloth attached thereto.

22 Claims, 6 Drawing Sheets

SEDIMENT CONTROL

CROSS-REFERENCE TO RELATED APPLICATIONS

This application is a continuation-in-part of my application Ser. No. 10/742,076 filed Dec. 19, 2003, now U.S. Pat. No. 6,848,866, the entire disclosure of which is incorporated herein for all purposes.

BACKGROUND OF THE INVENTION

This invention relates to the control of sediment. The term "sediment" is used herein to denote solid particulate material, e.g. soil, sand or pebbles, which can become suspended, or which is suspended, in a flowing stream of liquid, and which will settle out of the liquid when the liquid ceases to flow. The term "sediment control roll" is used herein to denote an article which can be transported and placed (i) on top of a substrate, usually the ground, in order to collect sediment from a sediment-bearing stream of liquid, usually water, which passes through the sediment control roll, or (ii) around an existing land mass composed of, for example, soil, sand, pebbles or rocks, in order to prevent or reduce removal of sediment from the land mass by water flowing towards, along, over or through the land mass. The term "land mass" is used herein to include, but is not limited to, a slope, a gully, a beach, or the bank of a body of water, e.g. a river or lake.

It is often desirable, and sometimes legally required, to collect sediment from liquid in which it is suspended, or to stabilize an existing mass of sediment to prevent it from being carried away. For example, in some cases, the law requires removal of sediment from liquid flowing out of a construction site. Often, there is neither time nor space to collect suspended sediment merely by placing the sediment-bearing liquid in a pond and allowing the sediment to settle. The conventional method for collecting sediment is to place hay bales or wattles across the path of the liquid. More recent methods are described in, for example, U.S. Pat. Nos. 6,422,787, 6,547,493 and 6,641,335, the disclosures of which are incorporated herein by reference. These known methods make use of large masses of water-absorbent materials which are secured to each other and/or held together by binders. The water-absorbent materials retain sediment and absorb large quantities of water until they are saturated. This makes them heavy, so that they are difficult or impossible to reuse and/or recycle. In many cases, they are left in place to form part of the landscape.

SUMMARY OF THE INVENTION

I have realized, in accordance with the present invention, that sediment can be effectively collected by directing a sediment-bearing liquid successively through (a) a threshold member which has a multiplicity of relatively large apertures therethrough and which reduces the speed of the sediment-bearing liquid,
(b) a substantially hollow sediment collection chamber, and
(c) an outflow filter having a multiplicity of relatively small apertures therethrough.

In some embodiments of the invention, the purpose in collecting the sediment is to prevent it from being deposited at undesirable locations. In other embodiments, the purpose is to prevent sediment from being removed from an existing land mass.

The threshold member, collection chamber, and outflow filter are conveniently combined together as a sediment control roll. Often, because filter materials do not generally have sufficient physical strength to be self-supporting under normal usage conditions, the outflow filter is supported by an outflow member which has a multiplicity of relatively large apertures therethrough and through which the liquid passes after it has passed through the outflow filter. In some embodiments, at least some of the sediment-bearing liquid, after it has passed through the threshold member and before it passes through the sediment collection chamber, passes through a threshold filter having a multiplicity of relatively small apertures therethrough, for example a threshold filter which is supported by, e.g. secured to the inside of, the threshold member.

The sediment collection chamber is "substantially hollow", the term "substantially hollow" being used herein to mean that the sediment collection chamber has an unobstructed volume which is at least 50%, e.g. 50 to 98%, particularly at least 70%, e.g. 70 to 97%, for example at least 80%, e.g. 80 to 96%, of the total volume of the sediment control roll. For example, in one embodiment, an outflow filter is secured inside the outflow member, and optionally a threshold filter is secured inside the threshold member and the volume between the threshold and outflow members is otherwise empty. The filter can be secured to the outflow member and/or to the threshold member in any convenient way, for example (a) by an adhesive (e.g. a thermal setting adhesive or a hot melt adhesive) or by melt bonding, and/or (b) by being sandwiched between the outflow or threshold member and an interior layer of the same or similar material having relatively large apertures therethrough. Alternatively (provided that the sediment collection chamber remains "substantially hollow" as defined above), there can for example be additional members which occupy some of the space between the threshold and outflow members. Such additional members may or may not have a substantial effect on the flow of liquid through the sediment collection chamber.

In many cases, the sediment control roll preferably includes a location member which extends tangentially away from the threshold and outflow members. When the sediment control roll is placed with its axis generally horizontal, for example to collect runoff from a construction site, the location member can be placed in a generally horizontal plane in contact with the ground, preferably so that the sediment-bearing liquid flows over the location member before reaching the threshold member. When assemblies of multiple sediment control rolls are used, the location members can be used to secure the adjacent rolls to each other.

In some preferred embodiments of the present invention, the sediment control rolls are, after each use, removed, cleaned and reused, and, after repeated use, are recycled. In other preferred embodiments, the sediment control rolls are left in place to form a retaining structure which stabilizes an existing land mass. In these embodiments, the sediment control roll can not only collect sediment which would otherwise be removed from the existing land mass, but also reduce the scouring force of water flowing over, along or towards the land mass, e.g. water rushing down a gully or waves generated by wind and/or boats.

In a first preferred aspect, this invention provides a sediment control roll which comprises 1) an elongate threshold member having a multiplicity of relatively large threshold apertures therethrough;
2) an elongate outflow member having a multiplicity of relatively large outflow apertures therethrough;

3) an elongate outflow filter which
   (i) is supported by, e.g. secured to, the outflow member and
   (ii) has a multiplicity of relatively small filter apertures therethrough;

the sediment control roll comprising a substantially hollow, elongate sediment collection chamber which lies between the threshold member and the outflow member.

In one embodiment of the first aspect of the invention, the threshold and outflow members are provided by a single piece of an apertured polymeric sheet which has been shaped into a generally tubular configuration comprising overlapping layers of the apertured polymeric sheet (e.g. rolled up into a generally cylindrical shape). The overlap can be limited to the extent needed to secure the overlap areas to each other, for example 0.5–6 inches (12.5–150 millimeters), e.g. 0.5–3 in (12.5–75 mm), or can be extensive, for example so that at least 20% of the outflow filter (and/or threshold filter, if present) is sandwiched between the overlapping layers. Preferably the apertured polymeric sheet also extends from the tubular configuration, thus providing all or part of a location member; in this case, the roll can include a sheet of filter material which not only provides the outflow filter but also extends over at least part of the location member.

In a second preferred aspect, this invention provides a method of collecting sediment from a flowing stream of a sediment-bearing liquid which comprises (A) passing the flowing stream through a threshold member having a multiplicity of relatively large threshold apertures (a) which pass through the threshold member and (b) whose size is such that at least a substantial proportion, preferably all, of the sediment can pass through the threshold member;

(B) passing the liquid stream from step (A) through a substantially unobstructed sediment collection chamber; and (C) passing the liquid stream from step (B) through an outflow filter having a multiplicity of relatively small filter apertures (a) which pass through the filter and (b) whose size is such that at least a substantial proportion of the sediment cannot pass through the filter.

Often, because filter materials do not generally have sufficient physical strength to be self-supporting under normal usage conditions, the method also includes the step of (D) passing the liquid stream from step (C) through an outflow member which supports the outflow filter and which has a multiplicity of relatively large outflow apertures passing through it.

Preferably, the sediment-bearing liquid is passed through a sediment control roll as defined in the first aspect of the invention.

In one preferred embodiment of this aspect of the invention, the flowing stream is run-off from a construction site. In another preferred embodiment of this aspect of the invention, the flowing stream comes from an existing land mass, and the method prevents or reduces removal of sediment from that land mass.

In a third preferred aspect, the invention provides a method of making a sediment control roll, preferably a sediment control roll according to the first preferred aspect of the invention, the method comprising (A) providing a precursor for a sediment control roll, the precursor comprising (i) an apertured sheet material having relatively large apertures therethrough, and (ii) a sheet of filter material which has relatively small apertures therethrough and which is secured to part or all of the apertured sheet material;

(B) shaping, e.g. rolling up, the precursor to provide a generally tubular body (a) which comprises first and second parts of the apertured sheet material which overlap each other, and (b) in which at least part of the filter material is secured to at least part of an interior surface of the tubular body, e.g. sandwiched between the first and second parts of the apertured sheet material; and (C) securing the overlapping first and second parts of the apertured sheet material together.

In step (C), the first and second parts can be secured together in any convenient way, e.g. by an adhesive, and/or by melt bonding, and/or by mechanical interlocking, for example by Velcro-like members, or by ties or hooks of metal or polymeric material. When the overlapping portions are secured together only by mechanical interlocking means, the interlocking means can be releasable, so that by releasing the mechanical interlocking means, the sediment collection roll can be restored to a relatively flat configuration for cleaning and/or storage and/or transport.

In one preferred embodiment of the third aspect of the invention, a portion of the apertured sheet material, preferably a portion having filter material secured thereto, extends tangentially from tubular body, thus providing a location member.

In a fourth preferred aspect, the invention provides a precursor suitable for use in the method of the third aspect of the invention, the precursor comprising (1) an apertured sheet material having relatively large apertures therethrough, and (2) a sheet of filter material which has relatively small apertures therethrough and which is secured to the apertured sheet material.

Such precursors can be substantially flat, making them easy to transport, e.g. to the site at which the sediment control rolls are to be used. When such precursors are assembled at the site, the securing together of the overlapping first and second parts is preferably accomplished at least in part by mechanical interlocking. The precursor can for example comprise a substantially rectangular apertured sheet material and a substantially rectangular sheet of filter material secured thereto, the sheet of filter material (a) having substantially the same size as the sheet of apertured sheet material and being secured thereto with substantially coincident edges (as for example in FIG. 8); or (b) having a size which is substantially less the size of the sheet of apertured material and being secured to the sheet of apertured sheet material so that three of the four edges are substantially coincident (as for example in FIGS. 11 and 14); or (c) having a size which is substantially less than the size of the sheet of apertured material and being secured to the sheet of apertured material so that two of the four edges are substantially coincident and (as for example in FIGS. 17 and 20).

The precursor can include additional components, e.g. an additional layer of apertured polymeric sheet material and/or members for use in securing the overlapping parts together to provide the tubular body.

BRIEF DESCRIPTION OF THE DRAWINGS

The invention is illustrated in the accompanying drawings, which are diagrammatic sketches and are not to scale, and in which.

DETAILED DESCRIPTION OF THE INVENTION

Figure 1:
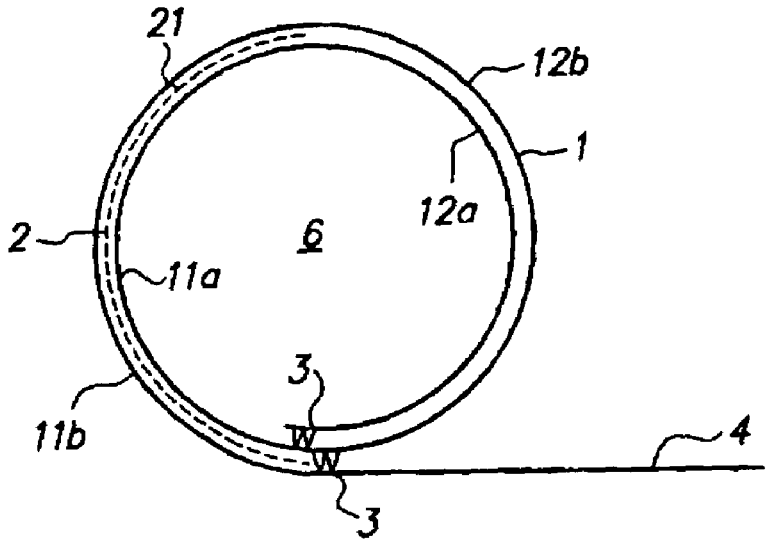
FIGS. 1–3 and 7 are cross-sections through sediment control rolls of the invention.

In the Summary of the Invention above, the Detailed Description of the Invention, the Examples, and the claims below, and the accompanying drawings, reference is made to particular features of the invention, including for example components, ingredients, devices, apparatus, systems and method steps. It is to be understood that the disclosure of the invention in this specification includes all possible combinations of such particular features. For example, where a particular feature is disclosed in the context of a particular embodiment, a particular Figure, or a particular claim, that feature can also be used, to the extent possible, in the context of other particular embodiments, Figures and claims, and in the invention generally. The invention claimed herein includes embodiments not specifically described herein and can for example make use of features which are not specifically described herein but which provide functions which are the same, equivalent or similar to, features specifically disclosed herein.

The term "comprises" and grammatical equivalents thereof are used herein to mean that other features are optionally present. For example, a sediment control roll "comprising" (or "which comprises") components A, B and C can contain only components A, B and C, or can contain not only components A, B and C but also one or more other components. Where reference is made herein to a method comprising two or more defined steps, then, unless the context requires otherwise, the defined steps can be carried out in any order or simultaneously, and the method can include one or more other steps which are carried out before any of the defined steps, between two of the defined steps, or after all the defined steps. The term "at least" followed by a number is used herein to denote the start of a range beginning with that number (which may be a range having an upper limit or no upper limit, depending on the variable being defined). For example "at least 20%" means 20% or more than 20%. When, in this specification, a range is given as "(a first number) to (a second number)" or "(a first number)-(a second number)", this means a range whose lower limit is the first number and whose upper limit is the second number. For example, "0.5–3" means a range whose lower limit is 0.5, and whose upper limit is 3. The numbers given herein should be construed with the latitude appropriate to their context and expression. The term "multiple" is used herein to mean two or more. When reference is made herein to "a", "an", "one" or "the" feature, it is to be understood that, unless the context requires otherwise, there can be one or more than one such feature.

Where reference is made herein to two or more components (or parts or portions etc.), it is to be understood that the components can be, unless the context requires otherwise, separate from each other or integral parts of a single structure or a single component acting as the two or more specified components.

Threshold Members

The apertures in the threshold member (the "relatively large threshold apertures") have a relatively large size such that at least a large proportion, preferably all, of the sediment can pass through the threshold member, and preferably such that the speed of liquid directed at the threshold member is substantially reduced. The threshold member is preferably the first part of the sediment control roll which opposes the flow of the sediment-bearing liquid. Often all the apertures have the same size and/or shape, though this is not necessary. The apertures can be of any shape, for example polygonal, including triangular and parallelogrammatic (including rectangular, e.g. square), round or oval. In some embodiments, each of the apertures is in the shape of a parallelogram in which the acute angles are from 60 to 82°, preferably 70 to 80°. Each of the apertures can for example have an area of 0.01 to 1.0, preferably 0.02 to 0.25, particularly 0.03 to 0.16, e.g. 0.04 to 0.1, $in^2$ (6.5 to 650, preferably is 13 to 160, particularly in 19 to 100, e.g. 25 to 65, $mm^2$), and/or a minimum dimension of 0.1 to 1.0, preferably 0.15 to 0.5, particularly 0.15 to 0.4, e.g. 0.2 to 0.3, in the (2.5 to 25, preferably 3.8 to 13, particularly 3.8 to 10, e.g. 5 to 7.5, mm). Such apertures provide little or no resistance to many of the sedimentary particles generally encountered in practice, but prevent the passage of larger objects floating on the liquid, for example sticks, cans and plastic bottles.

The greater the ratio of solid surface area to the total area of the threshold member, the more the threshold member will slow down the stream of sediment-bearing liquid. This reduction in the speed of the stream of liquid is accompanied by deflection of the sediment-bearing liquid in many directions. Both factors enhance removal of sediment from the liquid which has passed through the threshold member. However, if the stream is slowed too much, part of it may not be able to pass through the threshold member, and as a result some of the sediment-bearing liquid may flow over the top of the threshold member without any sediment being removed therefrom. In some embodiments of the invention, the solid surface area of the threshold member is 10 to 80%, for example 25 to 65%, of the total area of the exposed surface of the threshold member, both areas being viewed at right angles to the threshold member.

The threshold member can be composed of a multiplicity of strands, e.g. polymeric strands, connected together at junction points, thus providing a solid network, against and through which the sediment-bearing liquid flows. The thickness of the polymeric strands, viewed at right angles to the plane of the threshold member, can for example be 0.08 to 0.3 inch (2 to 7.5 mm), e.g. 0.1 to 0.2 inch (2.5 to 5 mm). Thus, materials suitable for use as the threshold member can be in the form of the heavier grades of netting obtained by melt-extruding an organic polymer. Methods for producing such netting are well-known, and may for example make use of two rapidly rotating, opposed extrusion heads, each set to extrude polymeric strands at the same angle to the principal axis of the resulting product, i.e. the machine direction. The resulting netting comprises generally parallelogram-shaped apertures defined by (i) a multiplicity of first strands which are parallel to each other and (ii) a multiplicity of second strands which are parallel to each other, the first strands and second strands being at the same angle to the principal axis of the netting. Especially when preparation of the sediment control roll includes rolling, or otherwise shaping, a length of such netting to provide the threshold member, and/or the outflow member, the acute angle between the first and second strands is preferably 60 to 82°, for example 70 to 80°. Preparation of such netting requires modification of the well-known techniques for preparing extruded netting, but those skilled in the art will have no difficulty, having regard to their own knowledge and the disclosure of this specification, in preparing such netting. The netting is preferably rolled (or otherwise shaped) so that the machine direction of the netting runs transversely around the resulting roll.

The threshold member is preferably composed of a polymeric composition (i.e. a composition containing a polymer and conventional additives such as fillers) which can be melt shaped, particularly a composition which does not absorb substantial amounts of water in use and/or which can be recycled and/or which is resistant to ultraviolet light, e.g. through the inclusion of 2–3% by weight of carbon black. Suitable polymers for the composition include polyolefins, particularly high density polyethylene and polypropylene. The polymer, in part or all of the threshold member, can be cross-linked, for example by exposure to electron beam radiation. It is preferable to avoid the use of polymeric compositions which can decompose, or release materials harmful to the environment, including wildlife, for example polymers containing plasticizers. Other materials that can be used for the threshold member are suitably apertured metal sheets, and interconnected metal wires, optionally coated with synthetic polymers.

When the threshold member is made up of two (or more) overlapping layers of the same (or different) apertured material, the effect of the threshold member on the stream of sediment-bearing liquid will depend upon the extent to which the strands defining the apertures overlap. If the apertures are all the same size and are directly on top of each other, the effective size of the apertures and the solid surface area of the threshold member of the two layers will be much the same as for only one of the layers. On the other hand, if the solid strands defining the apertures are staggered, the effective size of the apertures will be reduced, for example by 30–50% and the solid surface area will be increased, for example by 30–50%.

Outflow Members

The description above of threshold members is also applicable to outflow members. In many cases, the outflow and threshold members are provided by a single piece of suitable apertured material which is cut and shaped to provide the desired relationship between the two members and the rest of the sediment control roll. However, the outflow and threshold members can be separate pieces of the same apertured material, or separate pieces of different apertured materials.

If it is desirable to recycle the control roll, the outflow member is preferably composed of a material which is the same as the threshold member and the filter(s), or which can be recycled in the same batch as the threshold member and filter(s).

The threshold and outflow members are preferably composed of materials, and have dimensions, such that the sediment control roll has adequate strength, toughness and flexibility, without the need for additional support members. High density polyethylene offers a good balance between strength, flexibility, toughness, stability, cost, availability, ease of recyclability, and environmental acceptability. Other satisfactory polymers include polypropylene and low density polyethylene.

Filters

The outflow filter is contacted by the sediment-bearing liquid after the sediment-bearing liquid has passed through the threshold member and the sediment collection chamber, and before it passes through the outflow member. In some embodiments, there is also a threshold filter which is contacted by the sediment-bearing liquid before it passes through the sediment collection chamber. When there is both an outflow filter and a threshold filter, they may be composed of the same or different filter materials. For example, the size of the apertures in the outflow filter can be smaller than the size of the apertures in the threshold filter.

If there is a threshold filter, some of the sediment entrained by the liquid drops down in front of, or is retained in, the threshold filter. The sediment which passes through the threshold member (and through or over the threshold filter, if present) precipitates in the substantially hollow sediment control member either as a result of the reduction in the speed and/or change in direction of the liquid, or because it cannot pass through the outflow filter, and therefore drops down in front of, or is retained in, the outflow filter.

The outflow filter can extend over substantially all of the outflow member so that the capacity of the sediment collection chamber is as large as possible. However, this is not necessary. For example, in some embodiments, the outflow filter extends over only a lower section of the outflow member, the lower section extending for example from the bottom of the outflow member to an upper level which is at least 50%, e.g. 50 to 90%, preferably at least 70%, e.g. 70 to 90%, of the height of the sediment control roll.

The threshold filter, if present, can extend over substantially all of the threshold member, or can extend over only a lower section of the threshold member, the lower section extending from the bottom of the threshold member to an upper level which is at least 20%, e.g. 20 to 90%, or at least 35%, e.g. 35 to 80%, or at least 60%, e.g. 60 to 90%, of the height of the sediment control roll. The top of the threshold filter, if present, may be at a lower level than the top of the outflow filter. For example, the top of the outflow filter maybe higher by at least 10%, preferably by at least 30%, of the height of the sediment collection chamber. In another embodiment, there is a section at the top of the sediment roll which is free from filter material.

In use of sediment control rolls having a threshold filter, sediment will initially be deposited in front of the threshold filter, but as time goes on and sediment is deposited in front of the roll (or if there is a sudden surge of the sediment-bearing liquid), the sediment-bearing liquid may flow over the top of the threshold filter, directly into the sediment collection chamber, thus depositing further sediment within the sediment collection chamber.

If the characteristics of the sediment-containing liquid can be predicted, then the characteristics, including but not limited to the mesh size, of the outflow filter (and of the threshold filter if present) can be selected accordingly. In general, the filter layer(s) have a mesh size (measured by ASTM E-11) of 80 to 600 micron, preferably 100 to 500 micron, e.g. about 100 micron. Such filters are commercially available. The filter material can for example be sheet material having a substantially uniform thickness of less than 0.5 in (12.5 mm) or less than 0.25 in (6 mm), for example 0.01–0.06 inch (0.25–1.5 mm), preferably 0.01–0.05 inch (0.25–1.3 mm.), e.g. 0.015–0.045 inch (0.4–1.2 mm).

In tests in which clean water is passed through the filter material, on its own, the filter material, depending on its mesh size, is generally capable of passing at least 10, e.g. at least 20, gallons of water per square foot per minute, but not more than 60 or not more than 40, e.g. 18 to 35, gallons of water per square foot per minute (at least 0.4 $m^3$, e.g. at least 0.8 $m^3$, but not more than 2.5 $m^3$ or not more than 1.6 $m^3$, e.g. 0.7 to 1.4 $m^3$ of water per $m^2$ per minute).

Filter materials used in the present invention may need to be supported so that they are not displaced by the flowing liquid. In some embodiments, the filter material is secured to the outflow member or the threshold member. Alternatively or additionally, the threshold filter or the outflow filter may be secured to an interior support member. The interior support member can for example be an apertured polymeric sheet which is the same as the outflow member and/or the threshold member, or which has apertures larger than those in the outflow member and/or the threshold member. When the compositions of the threshold and outflow members and of the filter(s) and of the interior support member(s) if present, are such that they can be melt-bonded together (for example when they are composed of the same organic polymer), they are preferably secured to each other by melt bonding, for example along discrete lines or at discrete areas. Alternatively or additionally, they can be secured to each other, for example along discrete lines or at discrete areas, by adhesive, e.g. a thermal setting or melt adhesive, and/or through mechanical means, e.g. Velcro-type patches, or hooks or ties of metal or polymeric material.

The filter(s) is(are) preferably composed of a synthetic polymer, particularly a polymer which does not absorb substantial amounts of water in use and/or which can be recycled. Suitable polymers include polyolefins, particularly high density polyethylene and polypropylene. If it is desirable to recycle the control roll, the filter is preferably composed of a polymer which can be recycled in the same batch as the threshold and outflow members, and which is preferably the same as the polymer in the threshold and outflow members.

Sediment Control Rolls

The threshold member, filter(s) and outflow member are preferably secured together so that they form a sediment control roll as defined above, i.e. an article that can be transported and placed (i) on top of a substrate, usually the ground, to collect sediment from a sediment-bearing stream of liquid, usually water, which passes through the sediment control roll, or (ii) around a mass of sediment to prevent or reduce removal of the sediment by water flowing towards, over or through the mass of sediment. The threshold member, filter(s) and outflow member can be secured together in any convenient way. For ease of manufacture and for economy, the sediment control roll is preferably made by the process of the third aspect of the present invention.

The sediment control roll is preferably both strong and flexible so that it can be easily handled and will accommodate to uneven substrates, but yet will not be rendered unusable by rough treatment of the kind that is difficult to avoid at construction sites, for example people standing on and vehicles passing over the sediment control roll. Preferably, the sediment control roll, if subjected at room temperature, 70° F. (21° C.), to a test in which a weight of 200 lbs (90 kg) is applied uniformly to a 1 foot (300 mm) long section of the top of the roll for 20 seconds, and is then removed, the height of the roll, in the section underneath the weight, decreases by at least 25%, often at least 60% or at least 70%, e.g. up to substantially 100%, before the weight is removed, and recovers to at least 60%, particularly at least 75%, of its original height within one hour of the weight being removed. Preferably, the threshold and outflow members are shaped, and have sufficient tensile and flexural strength, to ensure that this is the case, without the need for additional support members. However, the sediment control roll can contain additional support members to provide desired dimensional stability. The invention includes the possibility that the sediment control roll is in a collapsed form which is suitable for storage and transport and which can be converted into usable form, e.g. a precursor according to the fourth aspect of the invention.

It is preferred that all the parts of the sediment control roll are constructed so that the roll does not absorb substantial quantities of water. For example, it is preferred that the roll, when subjected to a test which consists of (i) completely immersing the roll in water for 0.5 hour, (ii) removing the roll from the water, (iii) placing the roll on a horizontal apertured surface, and (iv) leaving the roll to drain for 0.5 hour in still air at 20° C., has a weight after the test which is not more than 1.3 times, preferably not more than 1.1 times, its weight before the test.

It is preferred that the sediment control roll is constructed so that, in a test in which clean water is directed towards the roll at right angles to the threshold member, the roll is capable of passing at least 10, e.g. at least 20, gallons of water, but not more than 40 gallons of water, per square foot per minute (at least 0.4 $m^3$, e.g. at least 0.8 $m^3$, but not more than 1.6 $m^3$, of water per square meter per minute) of the frontal area of the threshold member (i.e. the area of the threshold member as viewed from the front, e.g. for a cylindrical roll, the length times the diameter of roll). In such a test (and indeed likewise in practice) the structure of the roll is generally such that the volumes of water entering and leaving any particular length of the roll are substantially the same (e.g. differ by less than 20%, preferably less than 10%, based on the volume of water entering the roll), since the roll does not function as a pipe to direct liquid to the ends of the roll.

The dry weight of the sediment control roll is preferably such that it can readily be transported and placed in position manually. The weight may be for example 0.5 to 2.5, e.g. 0.65 to 1.8, lb/ft (0.7 to 3.7, e.g. 0.9 to 6 kg/m), with a total weight of for example 2 to 20 lb. (0.9 to 9 kg), preferably less than 10 lb (4.5 kg).

The tubular sediment control rolls of the present invention can be of any cross-section. Generally, but not necessarily, they have a constant cross section. Rolls having a generally circular cross section are easy to prepare, but rolls having other cross sections, for example oval or polygonal (including, for example, triangular and rectangular, including square) are also possible, and the greater base area of tubes of polygonal cross-section makes them more stable when placed in a generally horizontal position on the ground.

End Sections of Sediment Control Rolls

The end sections of the sediment control rolls of the invention can be completely open, or can be closed by a suitable end member, which may be apertured. The end member may be constructed so that it provides physical support for the roll and reduces the risk of the end of the roll being inadvertently crushed. Alternatively or additionally, the end member may be constructed so that two or more sediment control rolls can be joined together in line to provide an extended sediment control barrier. For example, one or both ends can include a bridging member which fits inside the roll and can be fitted inside an adjacent roll. When the sediment control roll is to be used to control the flow of sediment-bearing liquid into a drain, the ends of the roll can be shaped and/or include or be used in conjunction with auxiliary components, e.g. sandbags, to ensure that little or no liquid can enter the drain without passing through the collection roll.

Location Members on Sediment Control Rolls

As noted above, it is often preferred that the sediment control roll includes one or more location members which extend away from the sediment control roll. When the sediment control roll is to be placed in a generally horizontal position on the ground, e.g. to collect sediment in run-off from a construction site, the location member can be used to "key-in" (i.e. secure the roll in place), for example by driving one or more stakes through the location member(s) into the ground, and/or by scattering soil, sand, pebbles or other debris on top of part or all of the location member(s), and/or by digging a trench in the ground and burying part or all of the location member(s) in the trench. Preferably the location member(s) extend beyond the body of the sediment control roll when the roll is viewed in plan from above the roll. When the sediment control roll is part of an assembly of control rolls, as further described below, the location member can be used to secure the adjacent rolls together. When the sediment control roll is used to protect a drain, as further described below, the location member covers the horizontal surface of the drain.

Preferably the location member is in the form of a sheet. The sheet may for example comprise an unperforated polymeric film, or a sheet material having apertures therethrough; for example it maybe composed of the same material and/or be an extension of the outflow member. Especially when the location member comprises an apertured polymeric sheet material, it preferably also includes a filter which extends over at least part, preferably substantially all, of the location member. The filter can provide at least part, for example all, of the upper surface of the location member, and/or part or all of the filter can be sandwiched between a lower apertured sheet material and an upper apertured sheet material. Especially when the sediment roll is to be placed on a hard surface (e.g. concrete or asphalt), the location member preferably also includes a filter member which provides at least part of the bottom surface of the location member. The filter member helps to maintain the location member in contact with the underlying surface. The filter on the lower surface of the location member can be as defined above for the outflow filter; for example it can be composed of the same material as the outflow filter.

The location member can include one or more weights, for example around the periphery of the location member, and/or one or more weights, e.g. sandbags, can be placed on top of the location member of the roll has been put in place. This helps to secure the roll in place, and is especially useful when the sediment control roll is being used to control the flow of sediment-bearing liquid into a drain.

Assemblies of Sediment Control Rolls

Two or more sediment control rolls can be joined together end-to-end to form a longitudinally extended sediment control assembly. The joints between the sediment control rolls are preferably such that sediment control takes place at the joints as well as between them and/or the sediment-containing liquid cannot pass through the joints. The joints can for example be made by butting the two sediment control rolls together and joining them by mechanical means, e.g. hooks, ties, tapes, wires or clamps, which optionally are water-impermeable; and/or by means of a tubular bridging member which fits inside each of the rolls; and/or by melt-bonding and/or by adhesives, though this is often inconvenient in the field. When a polymeric bridging member is used, it can be apertured or apertured and can for example be prepared by a tubular extrusion process, or by rolling up a flat sheet of polymeric material, e.g. a sheet material similar to or identical with that used for the threshold and/or outflow member. When the rolls are to be joined at an angle to each other, the end of each roll can be trimmed to the desired angle and/or an angular tubular bridging member can be used. Alternatively, the sediment control roll itself can be constructed to have an angle in it.

Alternatively or additionally, two or more, e.g. six or eight, sediment control rolls can be joined together side-by-side, for example so that there are multiple rolls in one or two directions. Such assemblies can include reinforcing members. The resulting assembly can be placed on the ground with the axes of the rolls generally horizontal or as an angle to the horizontal, e.g. generally vertical. Such assemblies are particularly useful when a high volume of sediment-containing liquid is anticipated, or when the objective is to prevent existing masses of sedimentary material from being washed away. All the rolls can be of the same length, or they can be of different lengths. For example, they can be staggered regularly or irregularly to form a stepped assembly. A multiplicity of such stepped assemblies can for example be placed around an existing land mass, with the axes of the rolls as an angle to the horizontal, often with the longest rolls closest to the existing land mass, and then joined together, thus forming a type of retaining wall, as further described below.

As part of a manufacturing procedure, such assemblies can be for example made by joining the rolls to each other by melt-bonding, and/or by adhesives, and/or by mechanical means, for example through location members and/or by a sheet of apertured material wrapped around the assembly. In the field, the rolls (or manufactured assemblies of rolls) can for example be joined together by mechanical means, e.g. hooks, ties, tapes, wires or clamps, and/or by melt bonding, and/or by adhesives, though the use of melt-bonding and adhesives is often inconvenient in the field.

Use of Sediment Control Rolls to Stabilize Existing Land Masses

One valuable use of the sediment control rolls is to stabilize an existing land mass, e.g. a slope, a gully, a beach, or the bank of a lake, river or canal. For this use, it is preferred to use an assembly comprising a multiplicity of control rolls which are secured together and are installed with their axes at a substantial angle to the horizontal, e.g. 30 to 90°, for example so as to match the slope of the land mass to be stabilized.

Sometimes, it will be convenient to use a manufacturing process to secure together a relatively small number rolls, e.g. 4 to 20 rolls, to provide an assembly which can be transported to the installation site, and then to secure a plurality of such assemblies together at the site. The assemblies can be the same or different, and individual rolls or smaller assemblies can also be used to provide a desired final configuration. The bottoms and/or tops of adjacent rolls can be stepped, and can be at a right angle or other selected angle to the axes of the rolls, in order to fit to the terrain on which the rolls are to be placed, and/or to provide a desired upper contour.

After the rolls have been put in place, they can be secured to suitable restraints which are embedded in the land mass which is to be stabilized. This is a well-known procedure for retaining walls and the like. Preferably at least some of the sediment collection chambers are then filled with soil etc. to give the assembly greater weight, strength and rigidity, and the ability to support plant life.

Use of Sediment Control Rolls to Protect Drains

A sediment control roll having a location member can be used to control the entry of debris and sediment into drains, particularly roadside drains to which there is access through an opening in the curb and which have a rear portion which is unobstructed at the road level but is covered by the sidewalk. The drain may also have an exposed front portion set in the roadway and covered by a heavy grate. The collection member is placed over the opening in the curb. Preferably, the roll is long enough to be supported by the curb at each end. The collection chamber may have a diameter such that its top is also supported by the sidewalk. If the roll substantially covers the opening in the curb, the top section of the roll is preferably free of filter material, so that, if necessary, excess sediment-bearing liquid can flow relatively unimpeded into the drain. The location member extends into the roadway, and if there is a great in the roadway, over the grate. When the location member extends over the grate, it is longer than is required for other uses, for example 3 to 6 times the diameter of the collection chamber. For this use, the location member preferably comprises two overlapping layers of apertured polymeric sheet material having relatively large apertures therein, and, sandwiched between the overlapping layers, a layer of filter material having relatively small apertures therein.

Preparation of Sediment Control Rolls

The sediment control rolls of the invention can be prepared in any convenient way. The method of the third aspect of the invention is one satisfactory method for preparing rolls in which the threshold and outflow members comprise overlapping layers of a single piece of apertured sheet material. The method can also provide a location member which is part of the same piece of the apertured sheet material.

Figure 4:
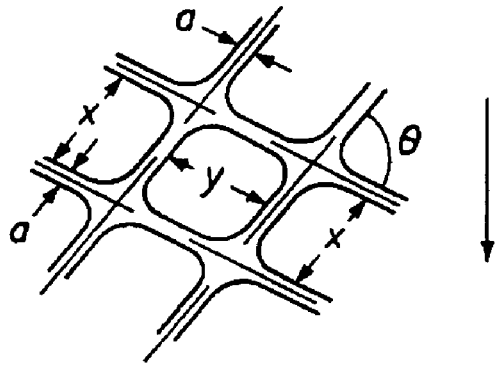
FIG. 4 is a plan view of a part of the exposed surface of a typical threshold member.

In a particular example of this method, a piece of high-density polyethylene netting about 45 in long is cut from the roll of the netting about 60 in wide and placed on a flat table. The polymeric strands and the apertures in the netting are as shown in FIG. 4, with the angle Θ being about 75°, a being about 0.062 in, x being about 0.225 in, and y being about 0.215 in. One of the 60 in edges is inserted into a slot cut into a mandrel which has a diameter of about 5 in and a length a little over 60 in. The mandrel is rotated, keeping the netting tightly wrapped around the mandrel, until the netting overlaps. An ultrasonic weld head is used to melt bond the overlapping layers along the line of the first overlap. One or more pieces of 200 mesh high-density polyethylene filter sheet of selected size are placed at selected positions on the netting which remains on the table (the size and position of the pieces of filter sheet depending on the on the filter(s) desired in the product), and are melt-bonded to the netting. The mandrel is again rotated, keeping the netting (and bonded filter material) tightly wrapped around the mandrel, until the netting again overlaps. The newly overlapping layers are melt bonded together. The remaining 5 in of netting still on the table provides the location member. Tubular sleeves having a length of about 10 in and a diameter slightly less than the inner diameter of the tube are prepared from high-density polyethylene sheet without apertures or from the netting material. The sleeves can be inserted into the ends of the roll so that two or more rolls can be joined together in a line.

The Drawings

Figure 2:
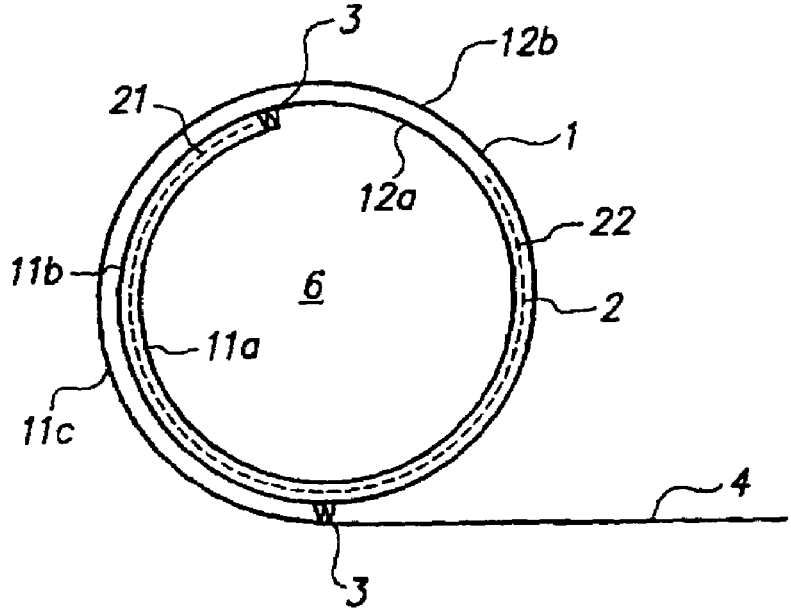
Figure 3:
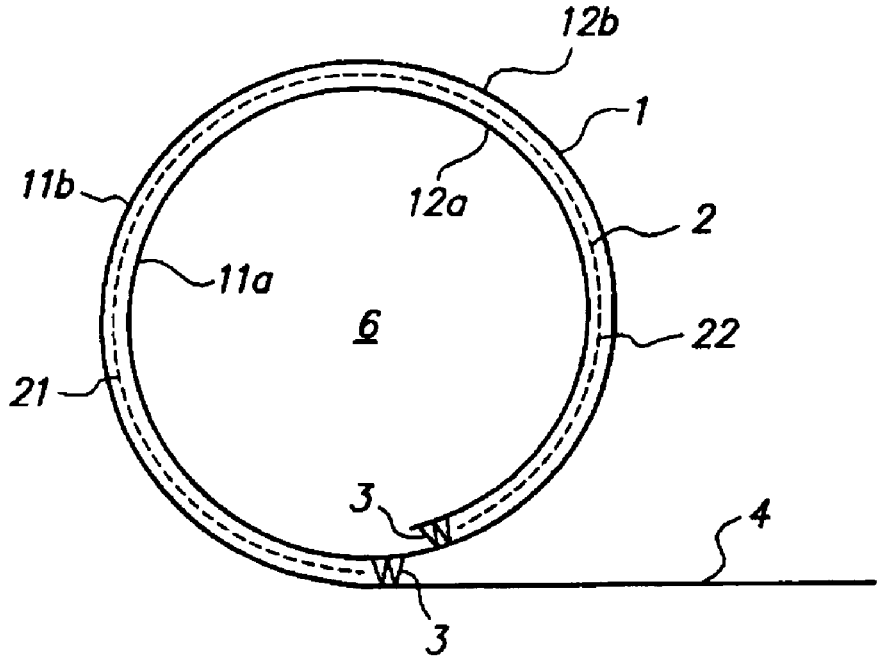
Figure 7:
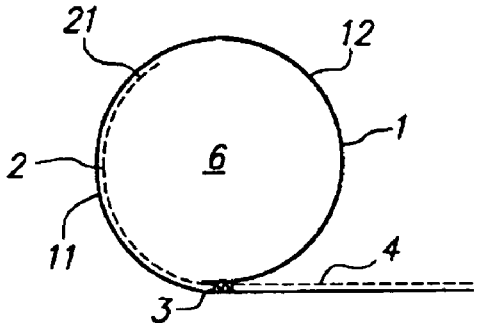

Referring now to the drawings, in which the same reference numerals are used to denote the same or similar components, FIGS. 1, 2, 3 and 7 show different sediment control rolls. In each of FIGS. 1, 2, 3 and 7, netting material 1 and filter material 2 have been rolled up and secured together, e.g. melt-bonded together, at locations 3, leaving flap 4 of the netting extending as a location member. In FIGS. 1–3, overlapping sections 11*a* and 11*b* (and in FIG. 2 also overlapping section 11*c*) of the netting material 1 provide the outflow member, and have outflow filter 21 sandwiched between them; and overlapping sections 12*a* and 12*b* provide the threshold member, and in FIGS. 2 and 3 (but not in FIG. 1) have threshold filter 22 sandwiched between them. In FIG. 2, the threshold filter extends to an upper level which is below the upper level of the outflow filter, thus leaving an upper filter-free section. In FIG. 3, the outflow and threshold filters form a continuous filter around the circumference of the sediment control roll. In FIG. 7, the extent of the overlap is limited to that needed to secure the overlapped areas together, and the filter 21 extends over, and forms the upper surface of, the location member. In each of FIGS. 1–3 and 7, sediment collection chamber 6 is enclosed by the threshold and outflow members.

FIG. 4 is a plan view of an example of the polymeric netting that can be used for the threshold and outflow members in the present invention. The netting has been prepared by extrusion in the machine direction shown by the vertical arrow in FIG. 4. The thickness of the polymeric strands is designated a; the acute angle of the parallelogrammatic apertures is designated Θ; the major dimension parallel to the polymeric strands is designated x; and the minor dimension parallel to the polymeric strands is designated y.

Figure 5:
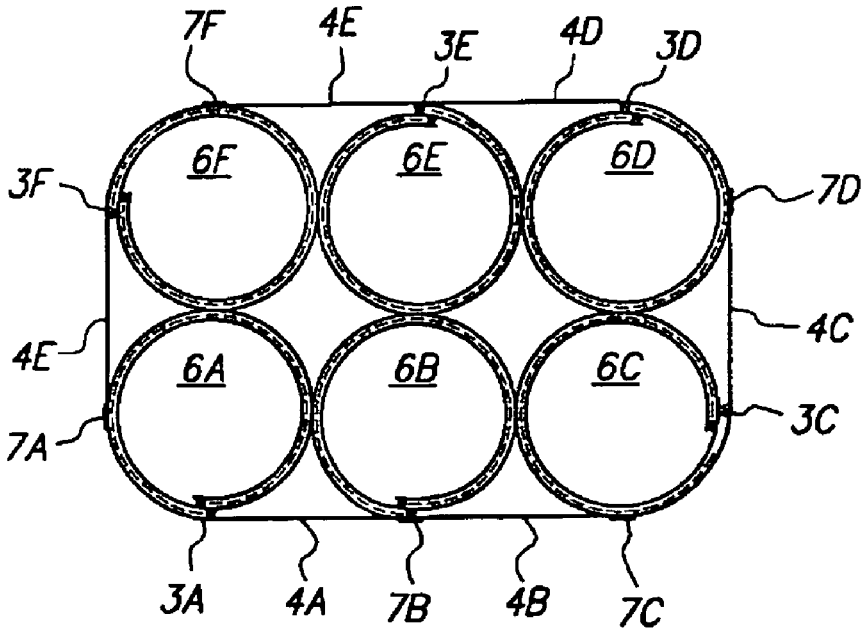
FIGS. 5 and 6 are plan and side views of an assembly comprising six sediment control rolls as shown in FIG. 3, FIGS. 8–9, 11–12, 14–15, 17–18 and 20–21 are top and cross-sectional views of five different precursors according to the fourth aspect of the invention.
Figure 6:
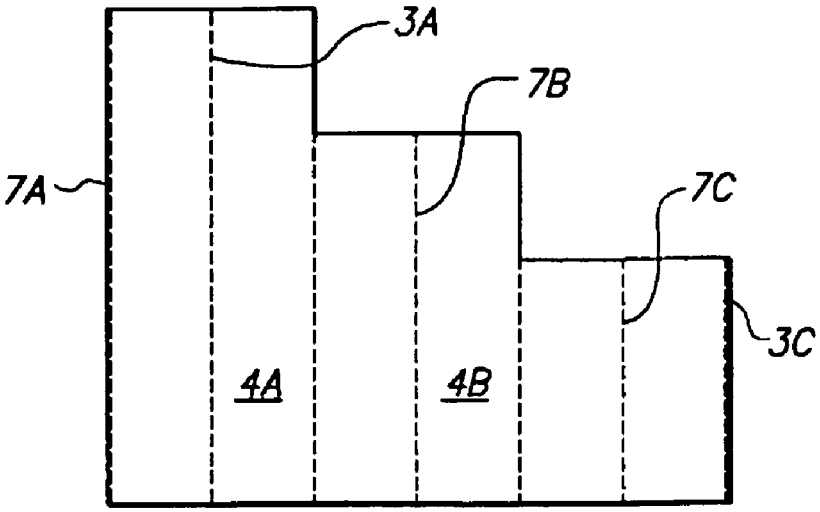

FIGS. 5 and 6 are plan and side views of an assembly made up of six sediment rolls as shown in FIG. 3, but of different lengths. The sediment rolls are joined together by melt-bonding respective location members 4A–4F to the adjacent sediment roll at locations 7A–7F.

Figure 8:
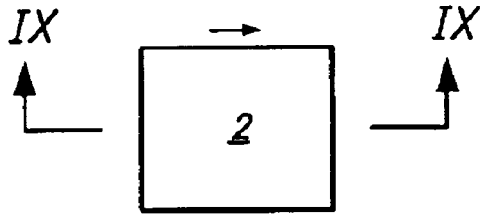
Figure 9:
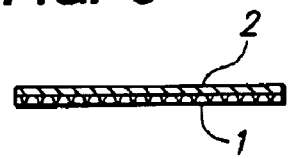
Figure 10:
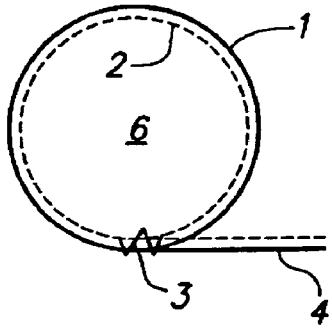
FIGS. 10, 13, 16, 19 and 22 are cross-sections of sediment control rolls which can be prepared by rolling up and securing overlapping areas of the precursors shown in FIGS. 8–9, 11–12, 14–15, 17–18 and 20–21 respectively.
Figure 11:
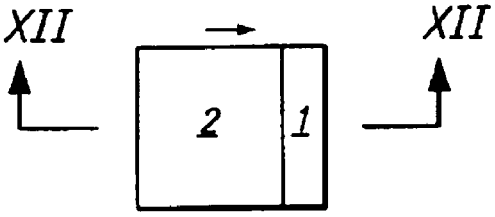
Figure 12:
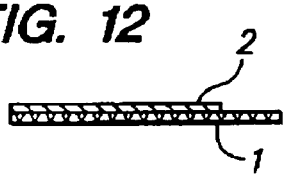
Figure 13:
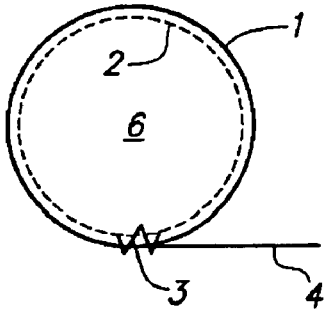
Figure 14:
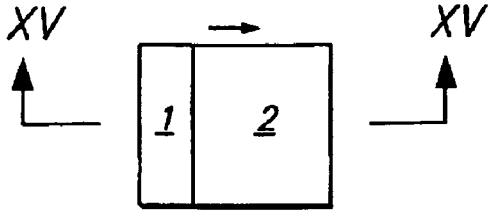
Figure 15:
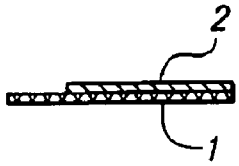
Figure 16:
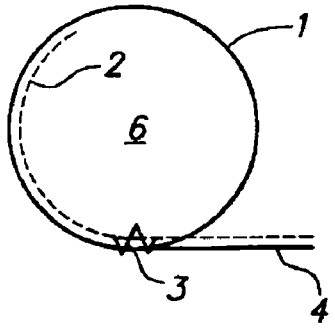
Figure 17:
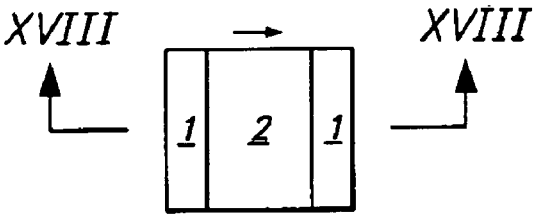
Figure 18:
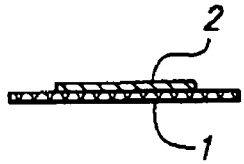
Figure 19:
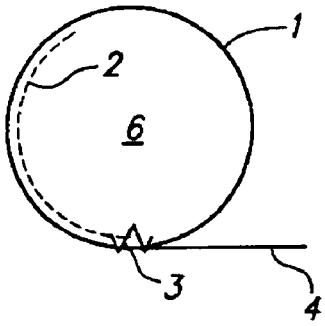
Figure 20:
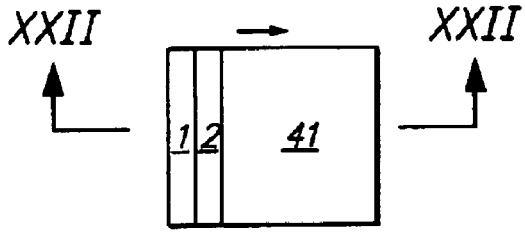
Figure 21:
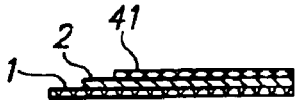

In FIGS. 8–22, a substantially flat precursor comprises netting 1 and filter material 2 extending over all (FIGS. 8–9) or a selected part (FIGS. 11–12, 14–15, 17–18 and 20–21) of the netting. The precursor can be rolled up, in the direction shown by the arrow in FIGS. 8, 11, 14, 17 and 20, and the resulting overlapped portions of the precursor secured together at locations 3 to provide a sediment collection chamber 6 and a location member 4. In FIG. 20, the precursor also includes an upper layer of netting 41 which forms the top surface of the location member in the resulting sediment collection roll shown in FIG. 22, which is particularly suitable for use in controlling the flow of sediment-bearing liquid into a drain.

Figure 23:
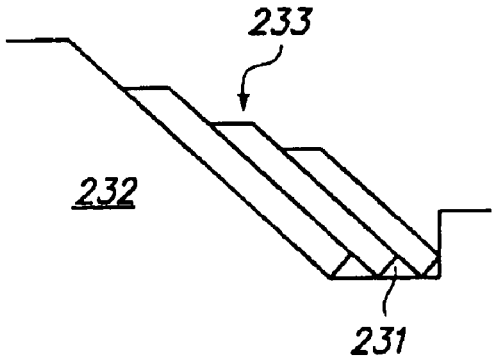
FIG. 23 is a cross-section of an assembly of sediment control rolls being used to stabilize a bank of soil.

In FIG. 23, a slope 232 of a land mass is stabilized by an assembly 233 of sediment control rolls. The bottoms of the control rolls are placed in a trench 231 which has been excavated at the bottom of the slope.

Figure 22:
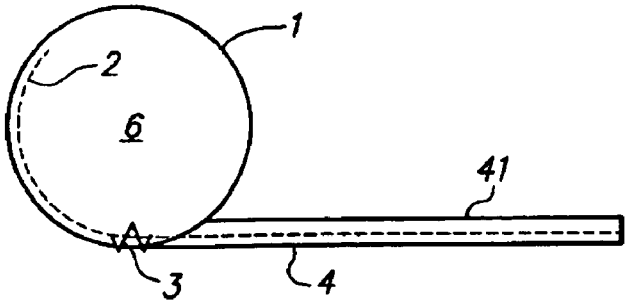
Figure 24:
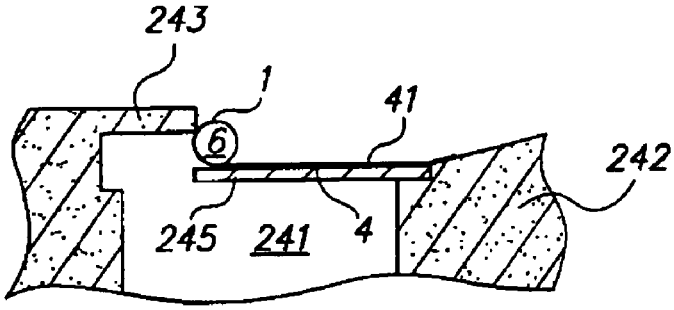
FIG. 24 is a cross-section.
Figure 25:
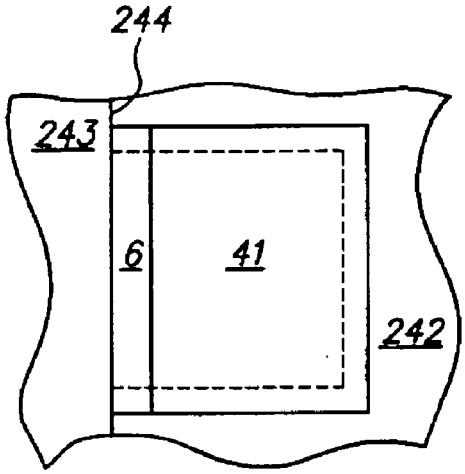
FIG. 25 is a plan view, of a sediment control roll being used to control the flow of sediment-bearing liquid into a drain.

In FIGS. 24 and 25, a control roll of the type shown in FIG. 22 is used to control the flow of sediment-bearing water into a drain 241 set into a road 242 which is bordered by sidewalk 243 having a curb 244. The drain is covered by grate 245 (whose periphery is shown by the broken line in FIG. 25), except for a rear portion underneath the sidewalk, to which there is access through an opening in the curb. The sediment collection chamber 6 covers the opening in the curb and contacts adjacent portions of the curb. The location member 4 covers the grate 245 and extends over adjacent portions of the road.

What is claimed is:

1. A sediment control roll which comprises 1) an elongate threshold member having a multiplicity of threshold apertures therethrough, each of the threshold apertures having an area of 0.01 to 1.0 $in^2$;

2) an elongate outflow member having a multiplicity of outflow apertures therethrough, each of the outflow apertures having an area of 0.01 to 1.0 $in^2$; and 3) an elongate outflow filter which (i) lies between the threshold member and the outflow member, and (ii) has a multiplicity of filter apertures therethrough, each of the filter apertures having an area of less than 0.01 $in^2$;

the sediment control roll comprising a substantially hollow, elongate sediment collection chamber which lies between the threshold member and the outflow filter.

2. A sediment control roll according to claim 1 wherein the outflow filter is secured to the outflow member, and the threshold and outflow members are provided by a single piece of an apertured polymeric sheet which has been rolled up into a generally tubular configuration comprising overlapping layers of the apertured polymeric sheet.

3. A sediment control roll according to claim 2 wherein the layers overlap over a generally rectangular area which extends over the length of the tubular configuration and is 0.5–3 in (12.5–75 mm) wide.

4. A sediment control roll according to claim 2 wherein the layers overlap over a generally rectangular area which extends over the length of the tubular configuration and is such that at least 20% of the outflow filter is sandwiched between the overlapping layers.

5. A sediment control roll according to claim 2 wherein the apertured polymeric sheet also extends from the tubular configuration, thus providing at least part of a location member.

6. A sediment control roll according to claim 2 wherein the overlapping layers of the apertured polymeric sheet are releasably secured to each other by releasable mechanical interlocking means.

7. A sediment control roll according to claim 1 which, when subjected at 70° F. to a test in which a weight of 200 lb is applied uniformly to a 1 foot long section of the top of the roll for 20 seconds, and is then removed, the height of the roll, in the section underneath the weight, decreases by at least at least 70% before the weight is removed, and recovers to at least 75% of its original height within one hour of the weight being removed.

8. A sediment control roll according to claim 1 which, when subjected to a test which consists of (i) completely immersing the roll in water for 0.5 hour, (ii) removing the roll from the water, (iii) placing the roll on a horizontal apertured surface, and (iv) leaving the roll to drain for 0.5 hour in still air at 20° C., has a weight after the test which is not more than 1.1 times its weight before the test.

9. A sediment control roll according to claim 1 which, when subjected to a test in which clean water is directed towards the roll at right angles to the threshold member, the roll is capable of passing at least 20 gallons of water, but not more than 40 gallons of water, per minute per square foot of the frontal area of the threshold member, and the volumes of water entering and leaving any particular length of the roll differ by less than 10%, based on the volume of water entering the roll.

10. A sediment control roll according to claim 1 which has a dry weight of 0.65 to 1.8 lb/ft.

11. A sediment control roll which comprises 1) an elongate threshold member which is composed of a multiplicity of polymeric strands; each of the polymeric strands having a thickness, viewed at right angles to the plane of the threshold member, of 0.1 to 0.2 in; the polymeric strands being connected together at junction points and defining a multiplicity of threshold apertures through the threshold member, each of the threshold apertures having an area of 0.02 to 0.25 $in^2$; and the solid surface area of the threshold member being 25 to 65% of the total area of the exposed surface of the threshold member;

2) an elongate outflow member which is composed of a multiplicity of polymeric strands; each of the polymeric strands having a thickness, viewed at right angles to the plane of the outflow member, of 0.1 to 0.2 in; the polymeric strands being connected together at junction points and defining a multiplicity of outflow apertures through the outflow member, each of the outflow apertures having an area of 0.02 to 0.25 $in^2$; and the solid surface area of the outflow member being 25 to 65% of total area of the exposed surface of the outflow member;

3) an elongate outflow filter which (i) is supported by the outflow member, (ii) comprises a synthetic polymer, and (ii) has a mesh size of 80 to 600 micron; and 4) a location member which extends away from the threshold and outflow members;

the sediment control roll comprising an elongate sediment collection chamber which (i) lies between the threshold member and the outflow member, (ii) has an unobstructed volume which is 50 to 98% of total volume of the sediment control roll.

12. A sediment control roll according to claim 11 which, when subjected at 70° F. to a test in which a weight of 200 lb is applied uniformly to a 1 foot long section of the top of the roll for 20 seconds, and is then removed, the height of the roll, in the section underneath the weight, decreases by at least at least 70% before the weight is removed, and recovers to at least 75% of its original height within one hour of the weight being removed.

13. A sediment control roll according to claim 11 which, when subjected to a test which consists of (i) completely immersing the roll in water for 0.5 hour, (ii) removing the roll from the water, (iii) placing the roll on a horizontal apertured surface, and (iv) leaving the roll to drain for 0.5 hour in still air at 20° C., has a weight after the test which is not more than 1.1 times its weight before the test.

14. A sediment control roll according to claim 11 which, when subjected to a test in which clean water is directed towards the roll at right angles to the threshold member, the roll is capable of passing at least 20 gallons of water, but not more than 40 gallons of water, per minute per square foot of the frontal area of the threshold member, and the volumes of water entering and leaving any particular length of the roll differ by less than 10%, based on the volume of water entering the roll.

15. A sediment control roll which comprises 1) an elongate threshold member having a multiplicity of threshold apertures therethrough, each of the threshold apertures having an area of 0.01 to 1.0 $in^2$;
2) an elongate outflow member having a multiplicity of outflow apertures therethrough, each of the outflow apertures having an area of 0.01 to 1.0 $in^2$;
3) an elongate outflow filter which
   (i) is secured to the outflow member, and
   (ii) has a multiplicity of filter apertures therethrough, each of the filter apertures having an area of less than 0.1 $in^2$; and
4) a location member which extends away from the threshold and outflow members;

the sediment control roll comprising a substantially hollow, elongate sediment collection chamber which lies between the threshold member and the outflow member; and the threshold member, the outflow member, and at least part of the location member being provided by a single piece of an apertured polymeric sheet having a multiplicity of apertures therethrough, each of the apertures having an area of 0.01 to 1.0 $in^2$.

16. A sediment control roll according to claim 15 wherein the location member includes a filter which extends over at least part of the location member.

17. A sediment control roll according to claim 16 wherein the filter is sandwiched between a lower apertured sheet and an upper apertured sheet.

18. A sediment control roll according to claim 15 wherein the location member includes a filter which provides at least part of the bottom surface of the location member.

19. A sediment control roll according to claim 15 wherein the apertured polymeric sheet is composed of a multiplicity of polymeric strands; each of the polymeric strands having a thickness, viewed at right angles to the plane of the threshold member, of 0.1 to 0.2 in; the polymeric strands being connected together at junction points and defining a multiplicity of apertures through the polymeric sheet, each of the apertures having an area of 0.02 to 0.25 $in^2$; and the solid surface area of the polymeric sheet being 25 to 65% of its total area.

20. A sediment control roll according to claim 15 wherein the outflow filter comprises a synthetic polymer, and has a mesh size of 80 to 600 micron.

21. A sediment control roll according to claim 15 which, when subjected at 70° F. to a test in which a weight of 200 lb is applied uniformly to a 1 foot long section of the top of the roll for 20 seconds, and is then removed, the height of the roll, in the section underneath the weight, decreases by at least at least 70% before the weight is removed, and recovers to at least 75% of its original height within one hour of the weight being removed.

22. A sediment control roll according to claim 15 wherein the threshold member and the outflow member are releasably secured to each other in an overlap area by releasable mechanical interlocking means.

* * * * *